US006196177B1

(12) United States Patent
VanderBok

(10) Patent No.: US 6,196,177 B1
(45) Date of Patent: Mar. 6, 2001

(54) ELECTRICAL SYSTEM FOR AN INTERNAL COMBUSTION ENGINE

(75) Inventor: Arnold J. VanderBok, Novi, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/274,002

(22) Filed: Mar. 22, 1999

(51) Int. Cl.[7] ..... F02N 17/06; F01M 5/02

(52) U.S. Cl. ..... 123/142.5 E; 123/196 AB; 219/202

(58) Field of Search ..... 123/196 AB, 142.5 E, 123/41.14, 145 R, 145 A; 237/12.3 R; 315/209 T, 209 SC; 219/202, 205, 208, 209

(56) References Cited

U.S. PATENT DOCUMENTS 3,798,072 * 3/1974 Anderson ..... 123/142.5 E
3,970,816 * 7/1976 Hosokawa et al. ..... 219/205
4,188,527 * 2/1980 Follmer ..... 219/202
4,463,738 * 8/1984 Lee et al. ..... 123/552
4,949,690 * 8/1990 Maurente et al. ..... 123/142.5 E
5,251,588 * 10/1993 Tsujii et al. ..... 123/142.5 R
5,255,733 * 10/1993 King ..... 165/299
5,291,960 * 3/1994 Brandenburg et al. ..... 180/65.2
5,483,927 * 1/1996 Letang et al. ..... 123/41.12
5,730,089 * 3/1998 Morikawa et al. ..... 123/41.14
5,749,330 * 5/1998 Inque et al. ..... 123/41.1
5,780,810 * 7/1998 Tsuchiya et al. ..... 219/202
5,896,833 * 4/1999 Aoki ..... 123/41.14

* cited by examiner

*Primary Examiner*—Andrew M. Dolinar
*Assistant Examiner*—Hai Huynh
(74) *Attorney, Agent, or Firm*—Bill C Panagos

(57) ABSTRACT

An improved electrical system for internal combustion engines which transfers electrically generated energy from the alternator to heat engine fluids, such as the coolant and the oil, thereby reducing engine warm up time, and/or exhaust emissions and/or fuel consumption.

17 Claims, 2 Drawing Sheets

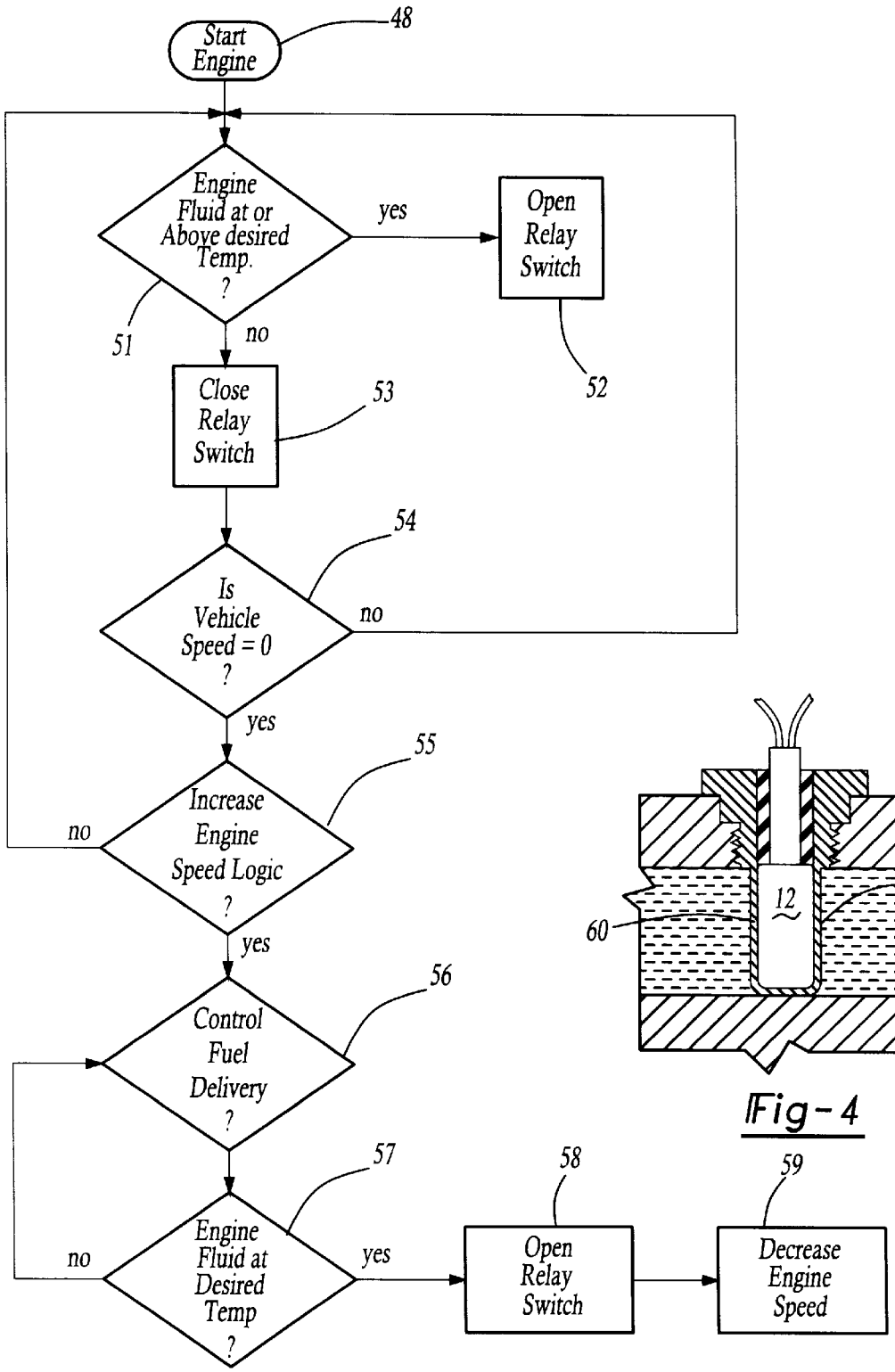
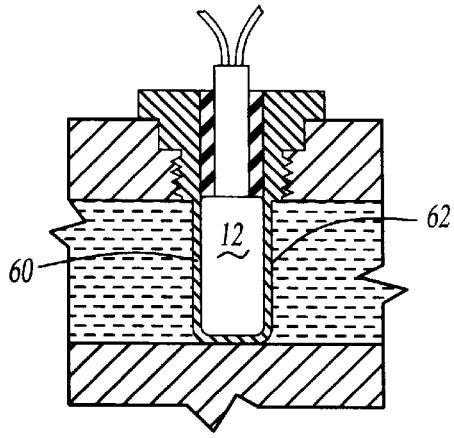
Fig-4
Fig-3

ELECTRICAL SYSTEM FOR AN INTERNAL COMBUSTION ENGINE

BACKGROUND OF THE INVENTION

1. Field of the Invention

The present invention relates to an improved electrical system for an internal combustion engine.

The present invention further relates to an improved electrical system for an internal combustion engine having an alternator or similar electrical energy generating electrical device, a battery, and electronic control unit (ECU) with a memory, and fluids for cooling and lubricating the engine.

The present invention further relates to a method to control the operation of an internal combustion engine and alternator in response to sensor input from engine fluids to raise said fluids to a desired temperature.

The present invention further relates to an improved electrical system for an internal combustion engine whereby the temperature of the engine fluids is sensed and electrical current is supplied from the alternator to a heat transfer means to heat the engine fluids to a desired temperature.

2. Description of the Related Art

Letang et al., U.S. Pat. No. 5,483,927 is directed to a method for engine control. The method integrates the use of a plurality of sensors to sense engine operating parameters and then modifying the fuel delivery to the engine in response to the sensor input. Coolant temperature and oil temperature, are two parameters which are sensed. There is no showing in Letang et al to supply current to a resistance in heat transfer relationship to an engine fluid to raise the fluid to a desired temperature or to control the fuel delivery based upon the temperature of the engine fluids.

Weisman II et al., U.S. Pat. No. 5,615,654 is directed to a method for comprehensive integrated control of a compression ignition engine. The control strategy integrates various functions of engine control, including fuel delivery strategy, cooling fan strategy, engine speed governing and overspeed protection. There is no showing in Weisman II et al to supply current to a resistance in heat transfer relationship to an engine fluid to raise the fluid to a desired temperature or to control the fuel delivery based upon maintaining the temperature of the engine fluids.

Weisman II et al., U.S. Pat. No. 5,647,317 is directed to an engine control strategy comprehensive integrated control of a compression ignition engine. The control strategy integrates various functions of engine control, including fuel delivery strategy, cooling fan strategy, engine speed governing and overspeed protection. There is no showing in Weisman II et al to supply current to a resistance in heat transfer relationship to an engine fluid to raise the fluid to a desired temperature or to control the fuel delivery based upon the temperature of the engine fluids.

SUMMARY OF THE INVENTION

The present invention is an improved electrical system for an internal combustion engine having an electronic control unit (ECU), said electrical system comprising a battery power source; an alternator connected to said battery for recharging said battery; a starter motor powered by said battery source; an ignition switch controlling current flow from said battery power source to said starter motor, said ECU having memory and connected to said power source and sensors. The improvement comprises at least one sensor connected to said ECU for sensing the temperature of at least one engine fluid, and a resistance in a current supply line from the alternator or other power generating apparatus, in heat transfer relation with an engine fluid; said current supply line having a relay controlled by the ECU to control the supply of current from the alternator to the resistance in response to sensor input to the ECU.

The present invention further relates to a control strategy to control the fuel delivery to the internal combustion engine in response to sensed temperature of engine fluids to control the current supply to the resistance means to raise the temperature of at least one of the engine fluids to a predetermined operating temperature.

These and other objects and advantages will become apparent upon a reading of the specification and claims of the present invention.

BRIEF DESCRIPTION OF THE DRAWINGS

FIG. 3 is a flow chart illustrating the method of engine control contemplated in the present invention.

FIG. 4 is a cut away detail of a coolant sensor used in the present invention.

DETAILED DESCRIPTION OF THE PREFERRED EMBODIMENT(S)

Figure 1:
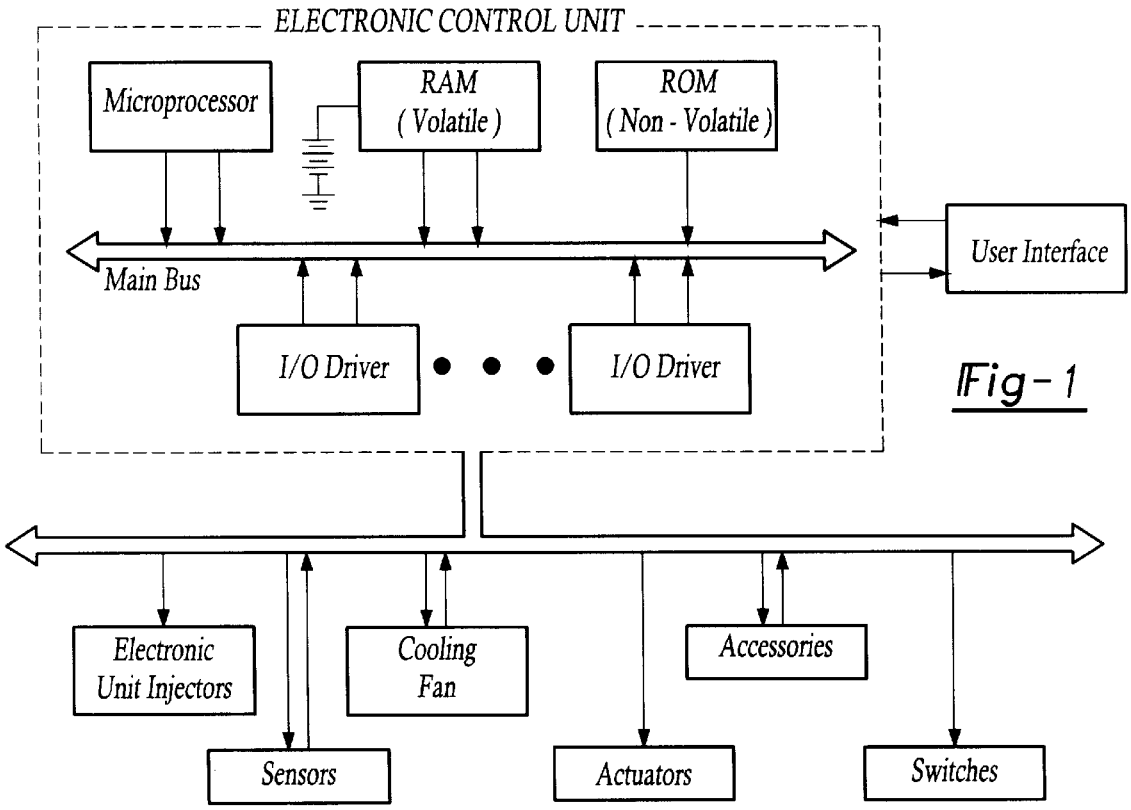
FIG. 1 is a block diagram of an integrated control system showing an electronic control unit in accordance with the present invention.

Turning now to the drawings, wherein like numerals refer to like structures, and particularly to FIG. 1, there is shown an electronic control unit (ECU) 20 in communication with typical engine componentry, shown generally by reference numeral 22 and a user interface 50. As shown the ECU 20 includes a microprocessor 24 having volatile random access memory (RAM) 26, nonvolatile read only memory (ROM) 28 and a battery (30) to maintain at least a portion of the contents of RAM 26 when the main power supply is off or disconnected. It is understood by those skilled in the art that the ECU 20 may contain other types of memory instead of, or in addition to, RAM 26 and ROM 28, such as EPROM, EEPROM, or FLASH memories.

The ROM 28 or other nonvolatile memory may contain instructions, which are executed to perform various control and information functions, as well as data tables, which contain calibration values and parameters that characterize normal engine operation. Microprocessor 24 imparts control signals to, and receives signals from, input and output (I/O) drivers 32. The I/O drivers 32 are in communication with the engine componentry 22 and serves to protect the controller from the hostile electrical impulse, while processing the signals and power necessary for engine control according the present invention. The ECU componentry detailed above is interconnected by data, address and control busses. It should be that there are a variety of other possible control schemes which include various combinations of microprocessors which could perform the same function.

With continuing reference to FIG. 1, preferably, engine componentry 22 includes a plurality of electronically controlled injectors 34, each corresponding to a single engine cylinder; a plurality of sensors 36 for indicating engine operating conditions such as coolant temperature, oil temperature, innercooler temperature, fuel temperature, throttle position, turbocharger compressor boost, oil pressure, transmission gear state, cylinder position, or cylinder sequencing; and at least one cooling fan 38. Engine componentry 22 also includes actuators 42 which may include solenoids, indicator lights, motors, generators, alternators; accessories 44 which may include air conditioning and vehicle lights; and switches 46 for operating the accessories 44, or for selecting various engine operating modes, such as cruise control mode. It should also be appreciated that the ECU 20 may also be in communication with other vehicle componentry and microprocessors that control associated vehicle systems, such as the brakes or transmission.

The user-interface 50 is used to store user calibration parameters and retrieve engine historical information logged as a result of diagnostic or malfunction codes. User calibration parameters may include adjustable limits such as desired engine oil life, maximum road speed or engine speed.

Figure 2:
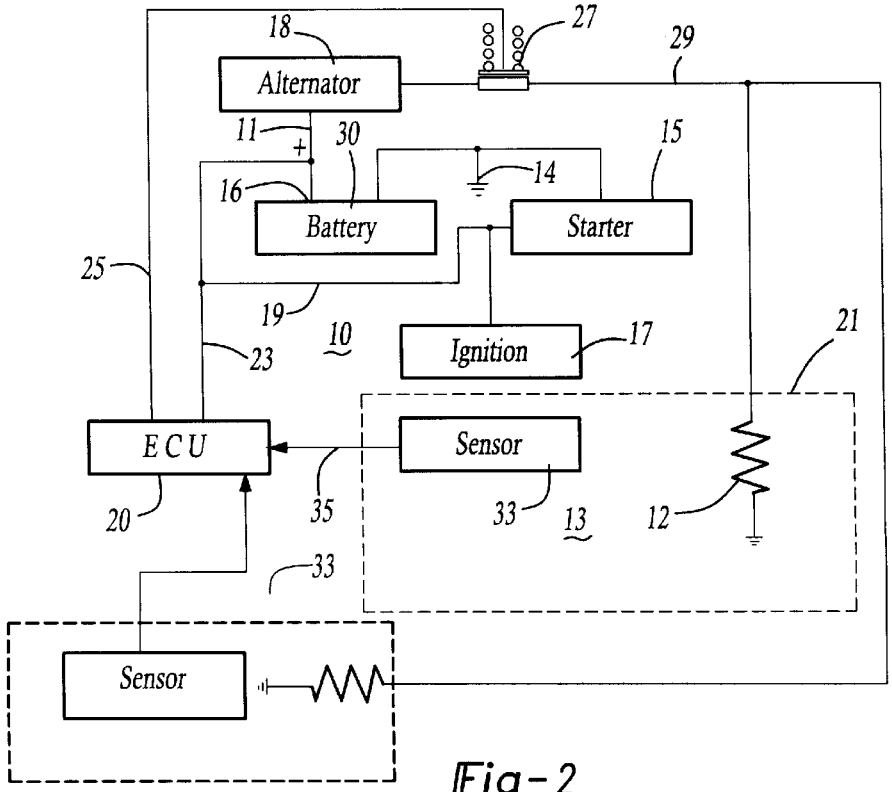
FIG. 2 is a schematic view of the improved electrical system.

Turning now to FIG. 2, there is illustrated a schematic of one embodiment of the improved electrical system of the present invention. Electrical system 10 includes a storage battery 30, with ground 14 and positive lead 16. Storage battery 30 may be a conventional lead acid battery, or may be of any other variety, such as an anhydride battery or any other configuration. An alternator, or other electrical generating accessory 18 is electrically connected to positive lead 16 through connection 11 to the battery. ECU 20 is also electrically connected to electrical connection 11, by connection 23, as are the accessories, such as vehicle lights, turning signals, radio, etc, (not shown). Since the load is directly connected to the battery, it will be appreciated that the load accessories may be operated regardless of whether the engine is operating or not. An electrical starter 15 is electrically connected to the battery through connection 14 and 19. and is activated by ignition switch 17. The ignition switch controls the flow of electrical current from the battery to the starter motor.

ECU 20 is equipped with an electrical connection 25, which terminates in a relay 27. Alternator 18 is also equipped with an electrical connection 29, which is interrupted by relay 27. Electrical connection 29 also has at least one resistance 12 that is in heat transfer communication with a desired engine fluid 13, such as engine coolant or engine oil, in compartment 21. Each resistance is designed to limit the flow of current. A sensors 33 for sensing the temperature of the engine fluid is in temperature detecting communication with the engine fluid and electrical communication with the ECU via electrical connection 35. The first sensor and the second sensor are in communication with the ECU, and separate current supply lines from the alternator with separate resistance in each line.

In operation, the ECU is connected directly to the battery, and is supplied with power regardless of whether the engine is operating. Sensor 33 is in temperature detection communication with an engine fluid, such as, for example, the engine coolant or oil. The temperature of the fluid is sensed, and communicated to the ECU. When it is desired to start the engine, the ECU causes the relay 27 to open. When the engine is running, the ECU closes the relay in response to sensed temperature, and electrical current flows from the alternator to the resistance 12. The resistance 12 is in heat transfer communication with the engine fluid and causes the fluid to be heated. When the fluid is heated to the desired temperature, the relay is opened and current ceases to flow from the alternator to the resistance.

FIG. 3 is a flow chart showing the functions of the method for control of the internal combustion engine to facilitate the selective flow of electrical energy from the alternator to the engine fluids.

After the engine has started as at step 48, the temperature of the engine fluid, such as coolant, is sensed as at step 51. The ECU has tables with values that are used to determine whether the fluid is at a desired temperature. If the fluid, such as coolant, is at or above a desired temperature, the relay 27 is not closed. If, however, a fluid temperature is detected which is not at or above a desired temperature, the relay switch is closed, as indicated in step 53. If the relay is closed, the vehicle speed is detected, as at step 54. If it is determined the vehicle speed is equal to 0 mph, the engine speed is detected, and compared against logic values in the ECU. If the engine speed is not adequate to facilitate the flow of current from the alternator to the coolant, engine speed may be increased by controlling the flow of fuel, as indicated at step 55. Once the fluid, such as coolant, is heated to the desired temperature, as at step 56, the relay is opened, thereby ceasing the current flow to the resistance as at step 57. The engine speed is then decreased by limiting the fuel delivery as at step 58. Thus, is can be seen that the engine fuel delivery can be controlled to regulate the flow of current to the resistance, depending upon the fluid temperature.

FIG. 4 shows one way in which the resistance can have a heat transfer relation to the engine fluid, such as coolant. As shown, the resistance is inserted into a well or probe 60 that extends through a wall of the engine into a coolant passage. Coolant flow through the passage transfers heat from the resistor to the coolant. Heat flow is in the direction of the resistance to the coolant. Preferably, the well material 62 is thermally conductive, whereby the heat from the resistance can be transferred to the coolant. When the coolant is cold, a maximum amount of heat is transferred from the resistance to the coolant. As the engine heats up, a lesser quantity of heat may be transferred to the coolant. The quantity of heat transferred is a function of the flow of electrical current to the resistance, which may or may not be regulated. Those skilled in the art recognize that while the resistance in relation to the engine coolant is described, a similar arrangement is contemplated for the engine oil, or any other engine fluid. The resistance is made of a material having a high thermal conductivity. It can be seen that with the present invention that engine warm up time is reduced because the electrically generated heat to the engine fluids minimizes cold engine operation and increased RPM (revolutions per minute) increases the heating rate of the fluids. Comfort in the vehicle cab is also improved since the heater system operates with warmer coolant sooner than conventional systems. Once the engine is warmed, fuel consumption is reduced, as are engine exhaust emissions.

While a preferred embodiment has been described, those skilled in the art recognize that the given description is not intended to illustrate all possible forms of the invention. It is also understood that the words used are descriptive only and that many variations will be possible without departing from the scope and spirit of the invention as disclosed.

I claim:

1. In an electrical system of an internal combustion engine having an electronic control unit (ECU), said electrical system comprising a battery power source; and alternator connected to said battery for recharging said battery; a starter motor powered by said battery source; an ignition switch controlling current flow from said battery power source to said starter motor, said ECU having memory and connected to said power source; the improvement comprising a first sensor to sense engine oil temperature, and a second sensor to sense coolant temperature, each sensor in communication with said ECU, and separate current supply lines from the alternator with separate resistance in each line in heat transfer relation with a respective engine fluid each said line having a relay controlled by the ECU to control the flow of current from the alternator to the resistance in response to sensor input to the ECU.

2. The improvement of claim 1, wherein said resistance is formed of a material having a high thermal conductivity.

3. The improvement of claim 1, wherein said internal combustion engine is a diesel engine.

4. The improvement of claim 1, wherein said electrical system is associated with an engine cooling system that includes a coolant passage in the engine; and a well extending within said engine into said coolant passage; said resistance comprising a resistor located in said well, whereby electrically generated heat is transferred from said resistor to the coolant in said passage.

5. The improvement of claim 1, wherein said electrical system is associated with an engine oil system that includes an oil reservoir in the engine; and a well extending within said engine into said oil reservoir; said resistance comprising a resistor located in said well, whereby electrically generated heat is transferred from said resistor to the oil in said reservoir.

6. The improvement of claim 1, wherein said ECU varies the engine speed and varies the alternator output in response to sensor input from said temperature sensors.

7. In an electrical system of an internal combustion engine having an electronic control unit (ECU), said electrical system comprising a battery power source; an alternator connected to said battery for recharging said battery; a starter motor powered by said battery source; an ignition switch controlling current flow from said battery power source to said starter motor, said ECU having memory and connected to said power source; the improvement comprising a first sensor connected to said ECU for sensing the temperature of an engine oil, and a second sensor connected to said ECU for sensing the temperature of an engine coolant; a first resistance in a first current supply line from the alternator in heat transfer relation with said oil; and a second resistance in a second current supply line from the alternator in heat transfer relation with said coolant; each said current supply line having a relay controlled by the ECU to control the flow of current from the alternator to the resistance in response to sensor input to the ECU.

8. The improvement of claim 7, wherein each said resistance is formed of a material having a high thermal conductivity.

9. The improvement of claim 7, wherein said internal combustion engine is a diesel engine.

10. The improvement of claim 7, wherein said electrical system is associated with an engine cooling system that includes a coolant passage in the engine; and a well extending within said engine into said coolant passage; said first resistance comprising a resistor located in said well, whereby electrically generated heat is transferred from said resistor to the coolant in said passage.

11. The improvement of claim 7, wherein said electrical system is associated with an engine oil system that includes an oil reservoir in the engine; and a well extending within said engine into said oil reservoir; said second resistance comprising a resistor located in said well, whereby electrically generated heat is transferred from said resistor to the oil in said reservoir.

12. The improvement of claim 7, wherein said ECU varies the engine speed and varies the alternator power output in response to sensor input from said temperature sensors.

13. A method for controlling the engine speed of an internal combustion engine, having an electronic control unit (ECU) with memory for controlling the engine, an electrical system comprising a battery power source; an alternator connected to said battery for recharging said battery; a starter motor powered by said battery source; an ignition switch controlling current flow from said battery power source to said starter motor, said ECU connected to said power source and having at least one sensor connected to said ECU for sensing the temperature of engine fluids including engine oil and engine coolant, and at least one resistance in a separate current supply line from the alternator in heat transfer relation with each said engine fluid; each said current supply line having a relay controlled by the ECU to control the flow of current from the alternator to each said resistance in response to sensor input to the ECU; the method comprising:

(a) starting the engine;

(b) sensing the temperature of at engine oil and engine coolant;

(c) supplying current from the alternator to the resistance;

(d) determining whether the vehicle is speed is greater than 0;

(e) sensing engine speed;

(f) controlling engine speed;

(f) ceasing the flow of current from the alternator to the resistance when a sensed temperature has reached a predetermined temperature.

14. The method of claim 13, wherein engine speed is controlled by controlling fuel delivery to the engine.

15. The method of claim 13, wherein current is supplied when the ECU closes a relay switch in the electrical line from the alternator to the resistance.

16. The method of claim 13, wherein current supply to resistance is ceased by the ECU opening a relay switch in response to sensed temperature.

17. The method of claim 13, further including the step of decreasing engine speed when an engine fluid has reached the predetermined temperature.

* * * * *